US007823820B2

(12) United States Patent
Eriksson et al.

(10) Patent No.: US 7,823,820 B2
(45) Date of Patent: Nov. 2, 2010

(54) INNER SHELL INTENDED FOR A GYRATORY CRUSHER, AND METHOD OF ATTACHING SUCH A SHELL ON A CRUSHING HEAD

(75) Inventors: Bengt-Arne Eriksson, Svedala (SE); Knut Kjaerran, Svedala (SE); Kjell-Åke Svensson, Limhamn (SE); Ib Mortensen, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 295 days.

(21) Appl. No.: 12/153,105

(22) Filed: May 14, 2008

(65) Prior Publication Data

US 2008/0290200 A1 Nov. 27, 2008

(30) Foreign Application Priority Data

May 16, 2007 (SE) ..... 0701184

(51) Int. Cl.
*B02C 2/00* (2006.01)

(52) U.S. Cl. ..... 241/207

(58) Field of Classification Search ..... 241/207–216
See application file for complete search history.

(56) References Cited

U.S. PATENT DOCUMENTS

| | | | | |
|---|---|---|---|---|
| 3,908,915 | A * | 9/1975 | Milenkovic | 241/208 |
| 4,666,092 | A * | 5/1987 | Bremer | 241/214 |
| 6,129,297 | A * | 10/2000 | Sawant et al. | 241/101.3 |
| 7,216,823 | B2 * | 5/2007 | Delille | 241/207 |
| 2006/0113414 | A1 | 6/2006 | Delille | |
| 2007/0272780 | A1 * | 11/2007 | Olsson et al. | 241/207 |

* cited by examiner

*Primary Examiner*—Faye Francis
(74) *Attorney, Agent, or Firm*—Drinker Biddle & Reath LLP

(57) ABSTRACT

An inner shell has a first part of a lug-notch arrangement, which first part is arranged to co-operate with a second part of the arrangement to prevent rotation of the inner shell relative to a crushing head. The inner shell has a contact surface in its upper portion and is arranged to be pressed towards the lower portion of the crushing head by a pressing force which is obtained by tightening at least two threaded bolts, which are arranged in the upper portion of the crushing head such that their longitudinal direction is substantially parallel to the symmetry axis of the crushing head.

20 Claims, 11 Drawing Sheets

*IIIa*

INNER SHELL INTENDED FOR A GYRATORY CRUSHER, AND METHOD OF ATTACHING SUCH A SHELL ON A CRUSHING HEAD

CROSS-REFERENCE TO PRIOR APPLICATION

The application claims priority to Sweden Application No. 0701184-4, filed May 16, 2007, which is incorporated by reference herein.

FIELD OF THE INVENTION

The present invention relates to a method of attaching, in a gyratory crusher, an inner shell to a crushing head having a lower portion and an upper portion that is narrower than its lower portion, the inner shell being configured to define, together with an outer shell of the crusher, a crushing gap for receiving a material to be crushed. The present invention further relates to an inner shell, which is configured to be attached, in a gyratory crusher, to a crushing head having a lower portion and an upper portion that is narrower than its lower portion, in order to define, together with an outer shell, a crushing gap for receiving a material to be crushed. The invention also concerns a gyratory crusher.

BACKGROUND OF THE INVENTION

A gyratory crusher of the kind stated above can be used for crushing, for example, ore and stone material into a smaller size. A gyratory crusher is usually provided with a crusher shaft and a crushing head, which is mounted about the shaft and arranged to support a first crushing shell in the form of an inner shell. The gyratory crusher further has a frame on which a second crushing shell in the form of an outer shell is mounted. The second crushing shell defines, together with the first crushing shell, a crushing gap into which the material to be crushed can be introduced.

In the course of the crushing operation, the crushing shells are worn down, which means that they need to be replaced at regular intervals. Replacing the first crushing shell, which is mounted on the crushing head, usually implies loosening a fixing nut or screw. In US 2006/0113414, it is described how loosening a fixing screw has included, historically, relatively laborious measures, such as the use of a blowtorch and sledgehammer. In view thereof, US 2006/0113414 discloses an alternative solution including a blocking plate, which is arranged to press the first crushing shell towards the crushing head. The blocking plate is secured by means of bolts to a threaded stud, which is in threaded engagement with the crusher shaft. The blocking plate is provided with notches that engage corresponding lugs or ears on the first crushing shell. Due to the crushing process, the first crushing shell will be rotated about the crushing head. As a consequence, the first crushing shell will cause also the blocking plate to rotate, which in turn will rotate the threaded stud with the result that it is screwed down into the crusher shaft, thereby ensuring that the first shell is secured to the crushing head.

A drawback of the securing device disclosed in US 2006/0113414 is that it requires mounting of a great number of parts for securing the first crushing shell to the crushing head, and that the bolts used to secure the blocking plate on the threaded stud are subjected to high loads.

SUMMARY

It is an object of the present invention to provide a method of attaching an inner shell to a crushing head of a gyratory crusher, which method includes few steps and generates only small loads on the parts that secure the inner shell to the crushing head.

This object is achieved by a method where the inner shell is brought into contact with the crushing head by mounting it on the crushing head in a direction from the upper portion thereof towards the lower portion thereof, at least one lug is used to prevent unlimited rotation of the inner shell, when mounted on the crushing head, relative to the crushing head, the inner shell is pressed towards the lower portion of the crushing head by way of at least two threaded bolts, which are arranged in the upper portion of the crushing head, such that their longitudinal direction is substantially parallel to the symmetry axis of the crushing head, and then tightened.

One advantage of this method is that the shell can be mounted by way of conventional workshop tools, such as wrenches and spanners with fixed jaws, which match the bolts. No appreciable self-tightening of the bolts will occur, which facilitates dismounting of the inner shell. The lug prevents the inner shell from rotating about the crushing head, which reduces the load on the bolts and allows the use of bolts of relatively small dimensions.

According to a preferred embodiment, a spring element is arranged between the at least two threaded bolts and the inner shell. One advantage of this embodiment is that the changes in size to which the shell is normally subjected during the crushing operation can be absorbed by the spring element, without the bolts being subjected to excessive loads and/or the force pressing the inner shell towards the crushing head being reduced too much.

Suitably, the at least two threaded bolts are tightened to such an extent that the at least one spring element, after the at least two bolts have been tightened, retains at least 5% of the spring play of the spring element in its unloaded state. One advantage of this embodiment is that the spring element can absorb changes in size to the inner shell in both directions.

According to one embodiment, the at least two threaded bolts are inserted in bolt holes provided in a flange arranged in the upper portion of the inner shell, and are tightened so as to press the flange, and thereby the inner shell, towards the lower portion of the crushing head. The flange enables a very simple design including few parts.

According to another embodiment, the at least two bolts are inserted in bolt holes provided in a clamping ring, and are tightened so as to press the clamping ring towards the upper portion of the inner shell. The clamping ring allows the use of an inner shell of a very simple design.

Another object of the present invention is to provide an inner shell which is easy to mount on a crushing head of a gyratory crusher and dismount therefrom.

This object is achieved by an inner shell that has a first part of a lug-notch arrangement, which first part is arranged to prevent, in co-operation with a second part of the arrangement, unlimited rotation of the inner shell relative to the crushing head, the inner shell further having a contact surface in its upper portion and being arranged to be pressed towards the lower portion of the crushing head by a pressing force acting on the contact surface and obtained by tightening at least two threaded bolts which are arranged in the upper portion of the crushing head such that their longitudinal direction is substantially parallel to the symmetry axis of the crushing head.

One advantage of this inner shell is that it allows the use of bolts that are easy to mount and dismount, while ensuring a secure attachment of the inner shell to the crushing head. This is made possible, inter alia, by the fact that the function of fastening the inner shell, which is achieved by way of the bolts, has been separated from the function of preventing rotation of the inner shell about the crushing head, which is achieved with the aid of the lug-notch arrangement.

According to one embodiment, a lug is formed on the inner shell. According to another embodiment, a notch is formed in the inner shell, preferably in its upper portion.

According to a preferred embodiment, the inner shell is provided with a spring seat, which is configured for the arrangement of at least one spring element between the inner shell and the at least two threaded bolts. The spring seat allows the inner shell to be pressed towards the crushing head by a spring force, which means that changes in size to the inner shell can be handled without the bolts being subjected to excessive loads or the securing force becoming too small.

A further object of the present invention is to provide a gyratory crusher, wherein the inner shell is easier to mount and dismount than in prior-art crushers.

This object is achieved by a gyratory crusher where the inner shell has a first part of a lug-notch arrangement, a corresponding second part of the lug-notch arrangement being arranged adjacent the crushing head for preventing unlimited rotation of the inner shell relative to the crushing head, the inner shell being pressed towards the lower portion of the crushing head by way of at least two threaded bolts, which are arranged in the upper portion of the crushing head such that their longitudinal direction is substantially parallel to the symmetry axis of the crushing head.

One advantage of this gyratory crusher is that the inner shell is secured with the aid of devices, namely bolts and lugs, which are easy to mount and dismount, and which do not easily get stuck during operation of the crusher.

According to a preferred embodiment, the at least one spring element includes a cup spring, a coil spring or a rubber bushing. These devices are simple and robust spring elements that are capable of producing the desired spring force in connection with the bolts that secure the inner shell to the crushing head.

Preferably, the gyratory crusher is without a main shaft nut that is rotatable about the symmetry axis of a vertical shaft carrying the crushing head. A main shaft nut, which has an inner diameter that substantially corresponds to the outer diameter of the vertical shaft and which can be screwed onto a corresponding thread in the upper portion of the vertical shaft, is used in accordance with prior art to secure the inner shell to the crushing head. A main shaft nut of this kind, which often has an inner diameter of about 30-100 cm and is screwed on the outer periphery of the shaft, is difficult to mount and often get stuck during operation of the crusher. If a nut of this kind can be avoided, which is possible in the gyratory crusher according to the present invention, a lot of time is saved when mounting and dismounting an inner shell.

Further advantages and features of the invention will be apparent from the following description and the appended claims.

BRIEF DESCRIPTION OF THE DRAWINGS

In the following, the invention will be described by means of embodiments and with reference to the appended drawings.

DETAILED DESCRIPTION OF THE PREFERRED EMBODIMENTS

Figure 1:
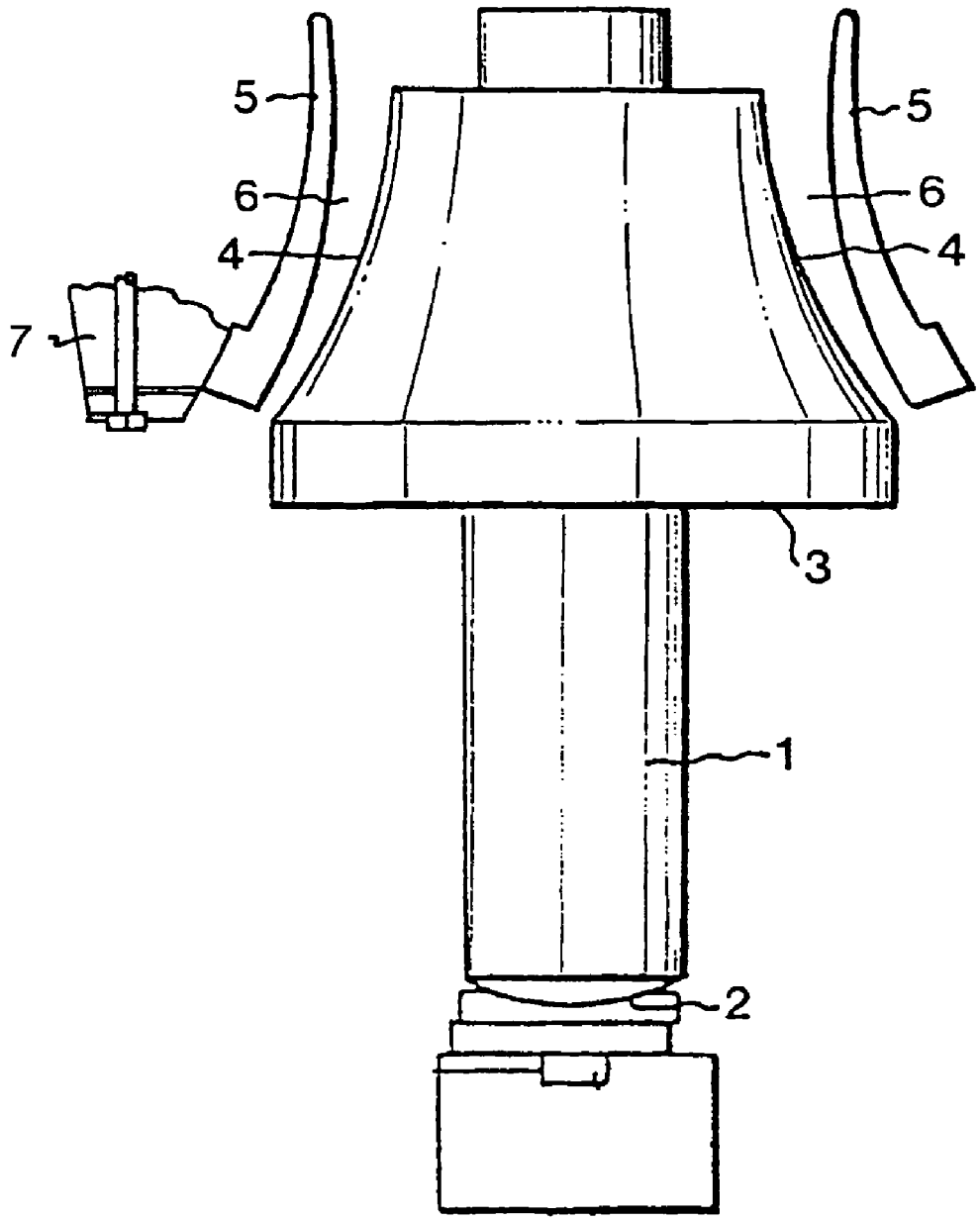
FIG. 1 is a schematic cross-sectional view of a gyratory crusher.

FIG. 1 illustrates schematically a gyratory crusher, which has a substantially vertical crusher shaft 1. At its lower end 2, the crusher shaft 1 is eccentrically mounted. At its upper end, the crusher shaft 1 carries a crushing head 3. A first crushing shell in the form of an inner shell 4 is mounted on the outside of the crushing head 3. A second crushing shell in the form of an outer shell 5 surrounds the inner shell 4. The inner shell 4 and the outer shell 5 define between them a crushing gap 6, the width of which in axial section decreases downwards, as shown in FIG. 1. The outer shell 5 is attached to a crusher frame 7, which is illustrated schematically in FIG. 1. The crusher shaft 1, and thus the crushing head 3 and the inner shell 4, can be raised and lowered by means of a hydraulic adjusting device (not shown). A motor (not shown) is arranged to cause the crusher shaft 1, and thereby the crushing head 3, to perform a gyratory pendulum movement during operation of the crusher, i.e., a movement during which both crushing shells 4, 5 approach one another along a rotating generatix and move away from one another along a diametrically opposed generatix. A material to be crushed is introduced in the crushing gap 6 and is crushed between the two shells 4, 5.

Figure 2:
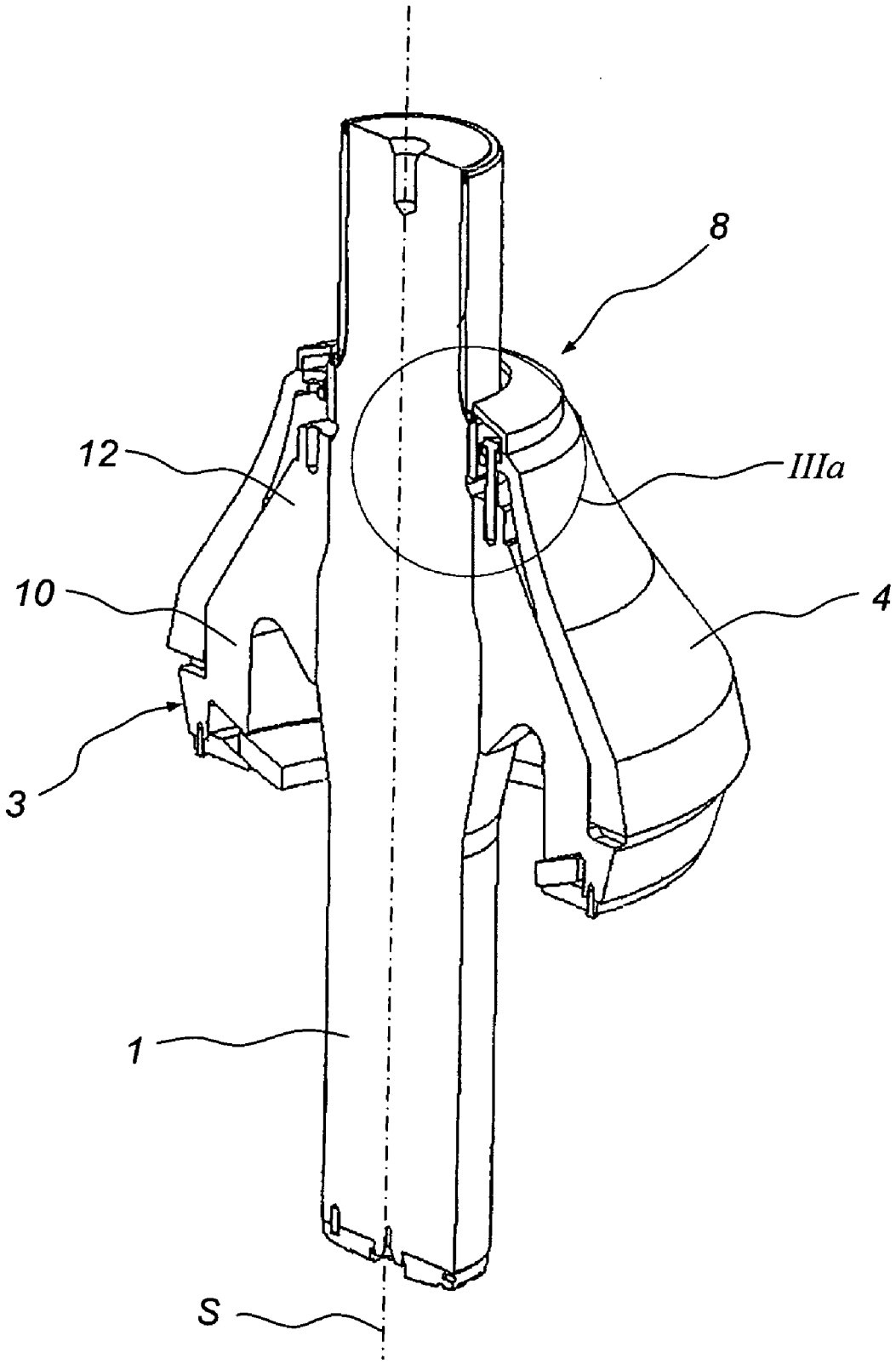
FIG. 2 is a schematic cross-sectional view of a device according to a first embodiment for securing an inner shell in the crusher.

FIG. 2 shows, in cross-section, the crusher shaft 1 and the crushing head 3 that carries the inner shell 4. When a material is being crushed in the gyratory crusher, great pressing forces will act on the inner shell 4. To ensure that such pressing forces are transmitted from the inner shell 4 to the crushing head 3 and then to the crusher shaft 1, the inner shell 4 needs to be securely fastened to the crushing head 3. The crushing operation will also produce forces that seek to rotate the inner shell 4 about the crushing head 3. A securing device 8 is arranged to secure the inner shell 4 to the crushing head 3 in such a manner that forces can be transmitted from the inner shell 4 to the crushing head 3, while at the same time the inner shell 4 is prevented from rotating about the crushing head 3. As will be described in more detail below, the securing device 8 is also arranged in a manner that allows the inner shell 4 to be easily disengaged from the crushing head 3 when the inner shell 4 is worn out and needs to be replaced.

The crushing head 3 has the shape of a supporting cone and has a lower portion 10 and an upper portion 12. As illustrated in FIG. 2, the upper portion 12 is narrower than the lower portion 10. When mounting the inner shell 4 on the crushing head 3, the inner shell 4, which is substantially cone-shaped, is applied in a direction from the upper portion 12 of the similarly cone-shaped crushing head 3 towards the lower portion 10 of the crushing head 3. The securing device 8 is then used to fasten the inner shell 4 to the crushing head 3 by forcing the inner shell 4 downwards, in the manner shown in FIG. 2, towards the lower portion 10 of the crushing head 3.

Figure 3A:
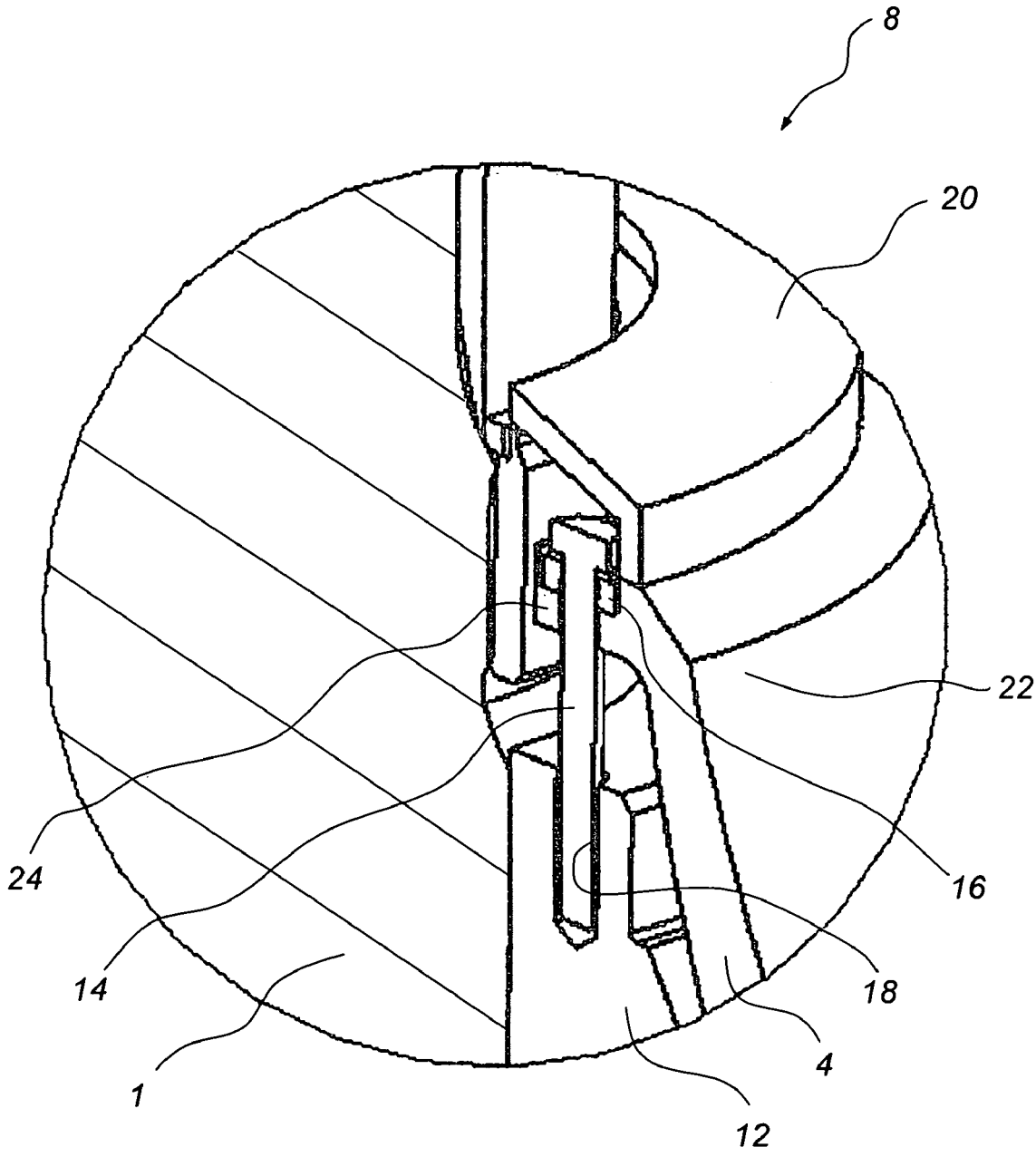
FIG. 3*a* is an enlarged view of the area IIIa shown in FIG. 2.

FIG. 3*a* illustrates the securing device 8 in greater detail. The securing device 8 includes eight threaded bolts, of which only one bolt 14 is shown in FIG. 3*a*, spring elements in the form of eight spring piles, one for each bolt, of which only one spring pile 16 is shown in FIG. 3*a*, and eight threaded holes in the upper portion 12 of the crushing head, of which only one hole 18 is shown in FIG. 3*a*. The bolts 14 are substantially parallel, in their longitudinal direction, to the symmetry axis S of the crusher shaft 1 and the crushing head 3, as shown in FIG. 2. The securing device 8 further includes a protective cover 20, which is designed to protect the bolts 14 and the spring piles 16 from the material being fed to the crusher. At its upper portion 22, the inner shell 4 is provided with a substantially horizontal flange 24.

Figure 3B:
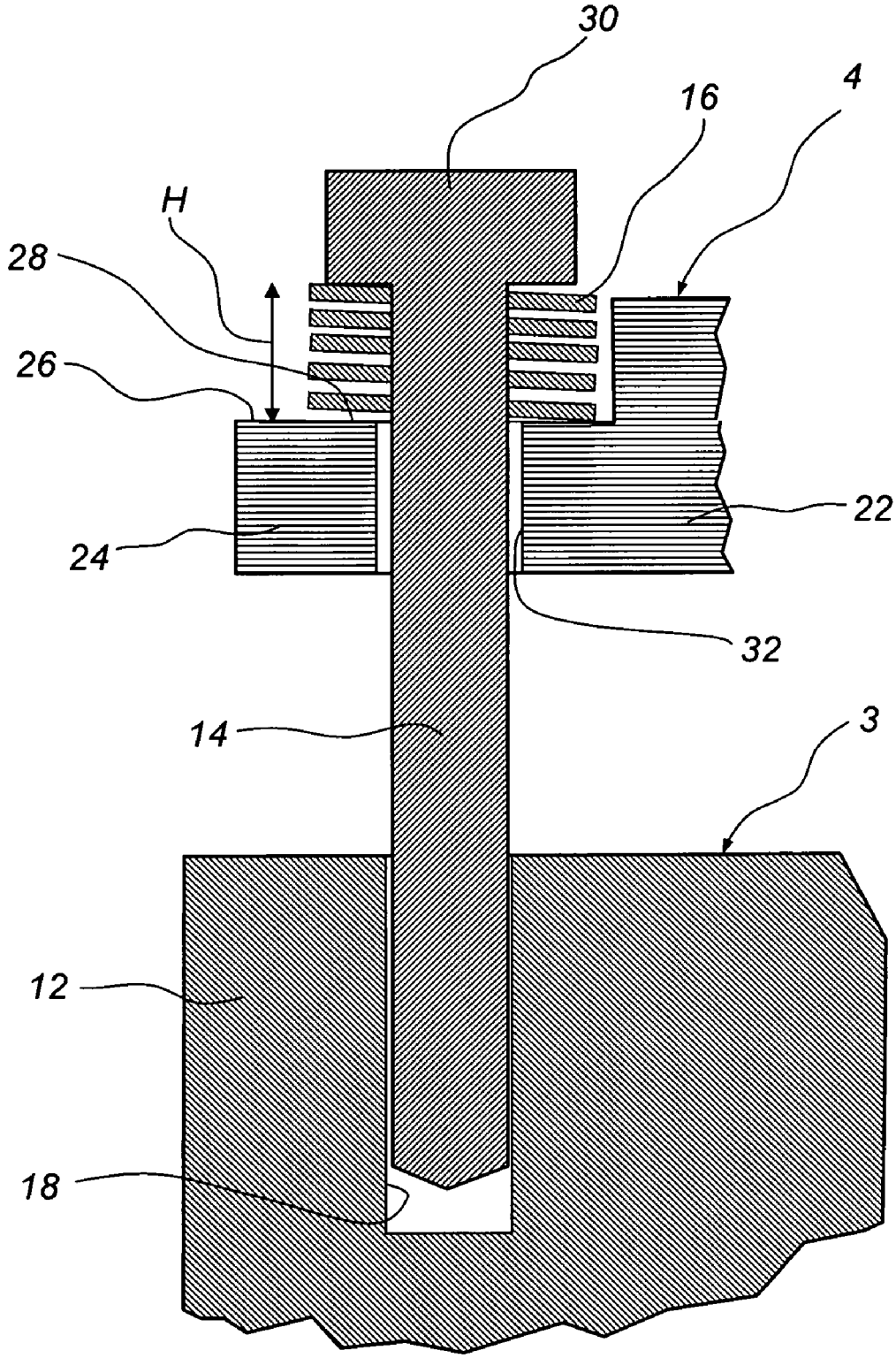
FIG. 3*b* is a schematic cross-sectional view illustrating the concept of securing the inner shell.

FIG. 3*b* illustrates in greater detail the concept of securing the inner shell 4 to the crushing head 3. The flange 24 of the inner shell 4 has a contact surface 26. The contact surface 26 has a spring seat 28. The spring pile 16 is secured by the bolt 14 between the head 30 of the bolt 14 and the spring seat 28. When fastening the inner shell 4 to the crushing head 3, a spring pile 16 is first slipped onto each bolt 14. Each bolt 14 is then inserted through an associated through bolt hole 18 in the flange 24 and penetrates into an associated threaded hole 18 in the upper portion 12 of the crushing head 3. With the aid of a fixed spanner, which is applied on the head 30 of the bolt 14, the bolt 14 is then tightened in such a manner that the head 30 of the bolt 14 forces the spring pile 16 against the spring seat 28 provided on the contact surface 26. This will cause the bolt 14 to press the flange 24, and thereby the inner shell 4, downwards, as shown in FIG. 3*b*, towards the crushing head 3 and to fasten the inner shell 4 to the crushing head 3. As shown in FIG. 3*b*, the spring pile 16 has a height H after the bolt 14 has been tightened to the desired torque. This height H should be such that the spring pile 16 retains at least 5% of its original spring play. This has the following implications: The spring pile 16 may, for example, have a total height of 30 mm in a completely unloaded state, and a total height of 10 mm in a completely compressed state, i.e., where no spring play at all remains. Accordingly, the total spring play of the spring pile 16 is 30−10=20 mm. When the bolt 14 has been tightened to the desired torque, at least 5% of the spring play should remain, i.e., at least 0.05*20 mm=1.0 mm of the original spring play should remain when the bolt 14 has been tightened to the desired torque. Thus, the height H according to FIG. 3*b* should be at least 10+1.0=11 mm after the bolt 14 has been tightened to the desired torque. It will be appreciated that the spring constant of the spring pile 16 is selected such that a desired tightening torque can be used for the bolts 14 without the remaining spring play of the spring pile 16 becoming less than that desired, as stated above.

When a material is being crushed in the gyratory crusher, the material will affect the inner shell 4. In many cases, this means that the inner shell 4 is pushed outwards and that its vertical extension increases. This vertical extension causes the inner shell 4 to expand upwards, which means that the flange 24 is displaced vertically upwards, as shown in FIG. 3*b*. Because the spring pile 16 retains a certain spring play, also after the bolts 14 have been tightened, this upward displacement of the flange 24 will not generate an excessive load on the bolts 14, since a vertical, upward displacement of the flange 24 can be absorbed by the spring pile 16.

Figure 4:
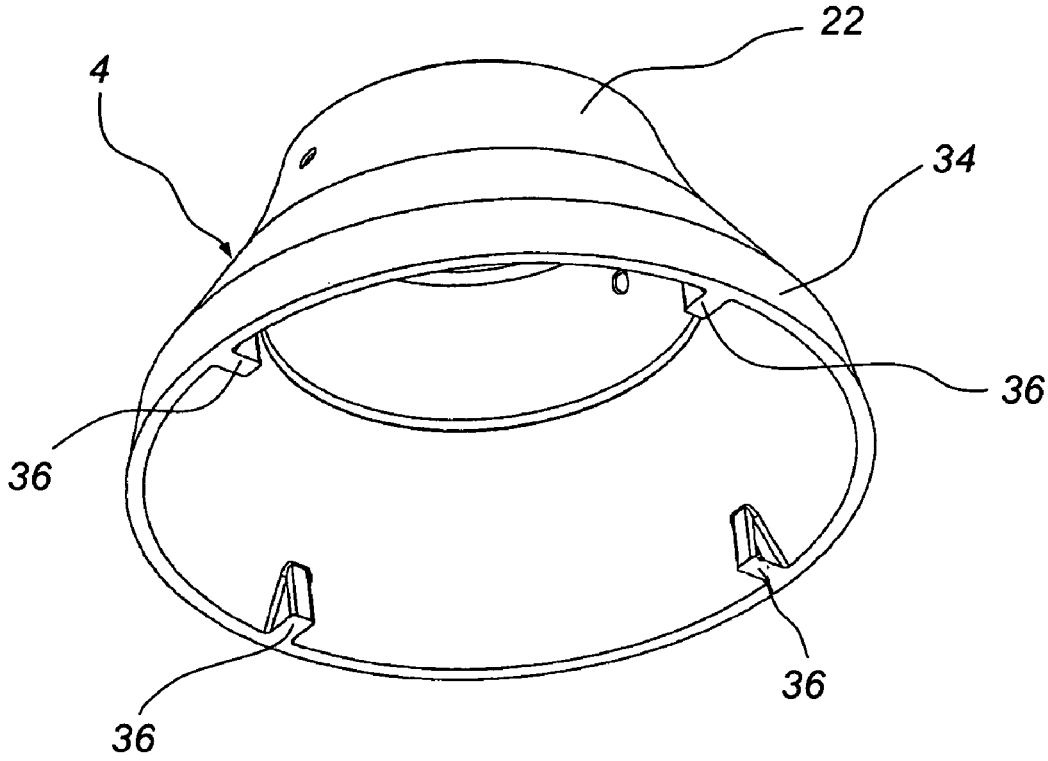
FIG. 4 is a three-dimensional view of the inner shell, as seen diagonally from below.

FIG. 4 shows how the inner shell 4, on the inside and in the lower portion 34 thereof, is provided with four lugs 36, which are uniformly distributed along the inner periphery of the inner shell 4. The four lugs 36 form first parts of a lug-notch arrangement, which is designed to prevent the inner shell 4 from rotating about the crushing head 3, as will be described in more detail below.

Figure 5:
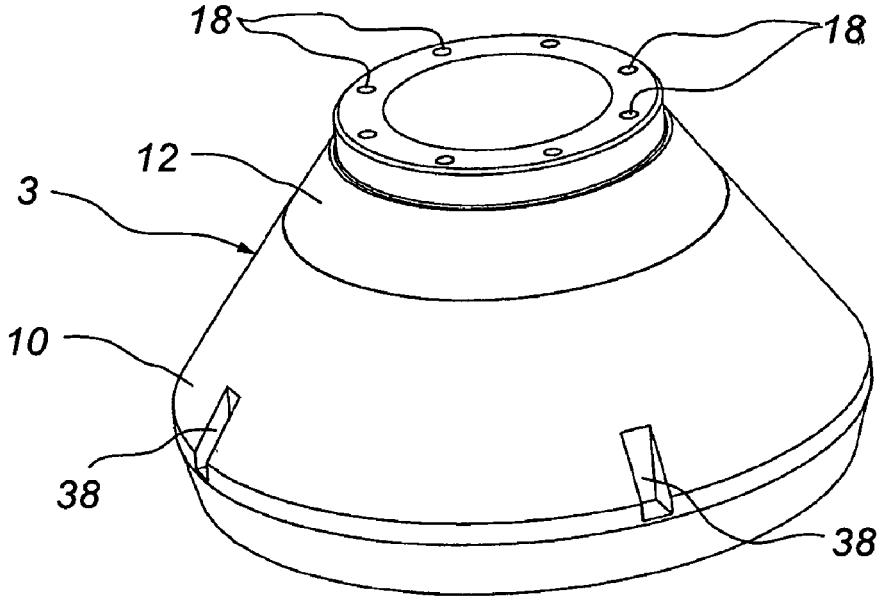
FIG. 5 is a three-dimensional view of the crushing head, as seen diagonally from above.

FIG. 5 shows the crushing head 3 having in the upper portion 12 thereof the eight threaded holes 18, which are intended for the bolts 14 shown in FIGS. 3*a* and 3*b*. In the lower portion 10 of the crushing head 3 four notches are provided, only two notches 38 of which are shown in FIG. 5, the notches being uniformly distributed along the periphery of the crushing head 3. The notches 38 constitute second parts of the lug-notch arrangement mentioned above. When an inner shell 4 is to be mounted on the crushing head 3, the inner shell 4 is lowered onto the crushing head in such a manner that the lugs 36 on the inside of the inner shell 4 are moved into engagement with the corresponding notches 38 in the outer periphery of the crushing head 3. When the lugs 36 are engaged with the notches 38, the inner shell 4 cannot be rotated relative to the crushing head 3. This means that the bolts 14 shown in FIGS. 3*a* and 3*b* are not subjected to shear forces during crushing of material in the gyratory crusher. By avoiding shear forces, the risk of the bolts 14 breaking or being stuck is greatly reduced.

Figure 6:
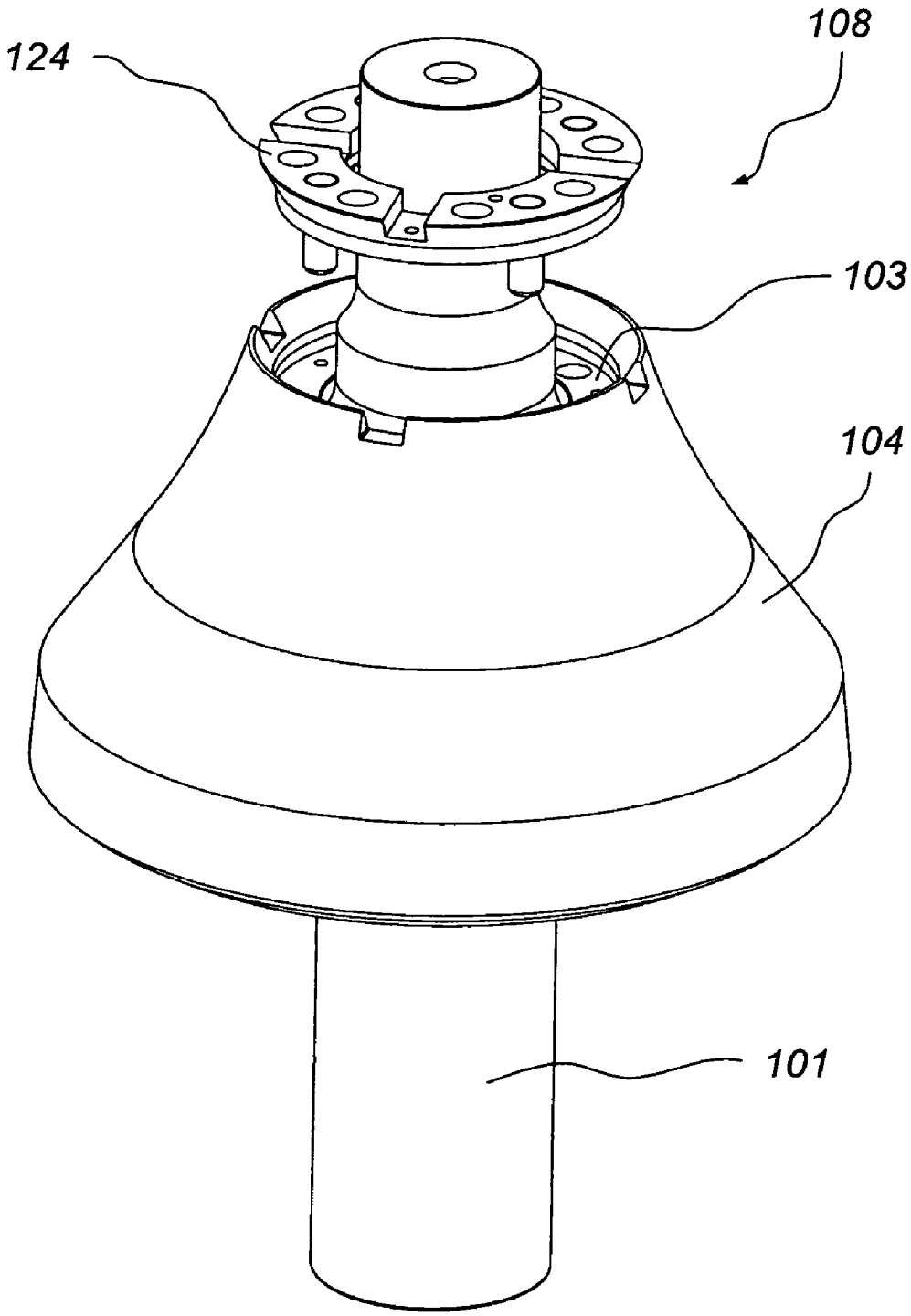
FIG. 6 is a schematic side view of a device for securing an inner shell to a gyratory crusher according to a second embodiment.

FIG. 6 illustrates the mounting of an inner shell 104 onto a crushing head 103, which is mounted on a crusher shaft 101. When fastening the inner shell 104 to the crushing head 103, a securing device 108 is used which includes, inter alia, a clamping ring 124.

Figure 7:
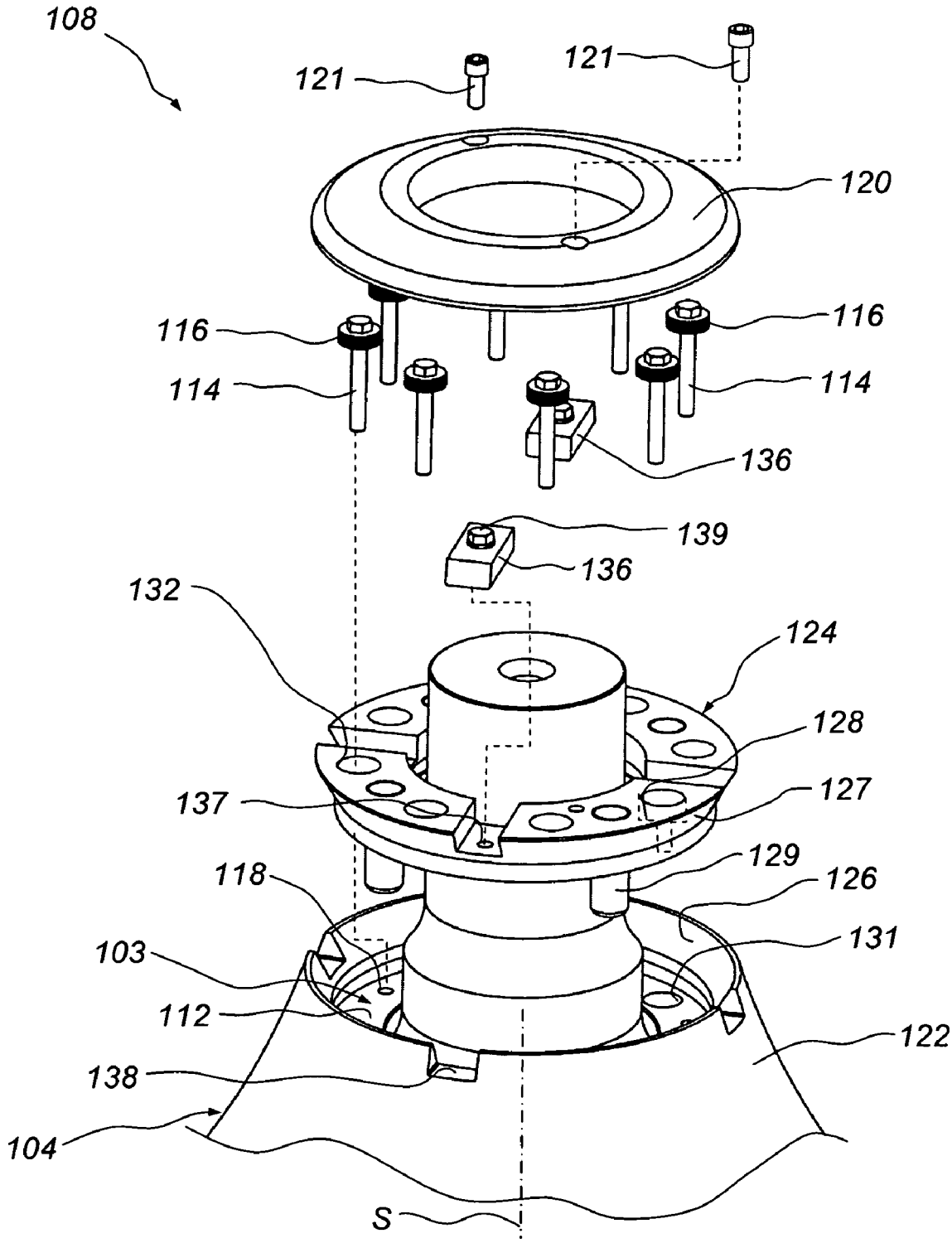
FIG. 7 is a side view of the different components of the device shown in FIG. 6.

FIG. 7 illustrates in greater detail the securing device 108 and the inner shell 104. On the inside of its upper portion 122, the inner shell 104 is provided with a conical contact surface 126. The inner shell 104 is further provided with a first part of a lug-notch arrangement in the form of a notch 138, which is formed in the periphery of the inner shell 104, at the upper portion 122 thereof. The clamping ring 124 has a conical contact surface 127, which is arranged to engage the contact surface 126 and press the inner shell 104 downwards, as shown in FIG. 7, towards the crushing head 103. The clamping ring 124 is provided with a number of guide pins 129, which are arranged to be inserted in corresponding guide pin holes 131 in the upper portion 112 of the crushing head 103. The purpose of the guide pins 129 is to prevent the clamping ring 124 from rotating relative to the crushing head 103. In its upper portion 112, the crushing head 103 further has eight threaded bolt holes 118, which have substantially the same design as the threaded bolt holes 18 shown in FIGS. 3*a* and 3*b*. The clamping ring 124 has eight through bolt holes 132, the positions of which correspond to the positions of the threaded bolt holes 118. Eight bolts 114 are arranged to be inserted through the through bolt holes 132 in the clamping ring 124, in parallel to the symmetry axis S of the crushing head 103, and to be screwed into the bolt holes 118 in the crushing head 103. Each bolt 114 is provided with a spring pile 116 of a type similar to the spring piles 16 described above. The bolt holes 132 extending through the clamping ring 124 are partly countersunk and have spring seats 128, as indicated in FIG. 7, which means that each spring pile 116 will penetrate a certain distance into the clamping ring 124 before it abuts against each spring seat 128 in the respective bolt holes 132 of the clamping ring 124. When the bolts 114 are tightened to the desired torque, they will press the clamping ring 124 downwards, as shown in FIG. 7, towards the crushing head 103 and towards the contact surface 126 of the inner shell 104. The bolts 114 are tightened in the manner described above, i.e., such that the spring piles 116 retain at least 5% of their spring play in the unloaded state. Thus, the securing device 108 works according to a concept similar to that of the securing device 8, the difference being that the bolts 114 push a clamping ring 124 downwards, which in turn pushes the inner shell 104 down towards the crushing head 103.

In its upper portion, the clamping ring 124 is further provided with two recesses, one recess 137 of which is shown in FIG. 7. Two lugs 136, which form the second part of the lug-notch arrangement, are configured to be secured by way of bolts 139 in an associated recess 137 in the clamping ring 124. The lugs 136 are designed in such manner that each lug 136, when secured in the associated recess 137, will penetrate into a corresponding notch 138 in the upper portion 122 of the inner shell 104. The lugs 136 will thereby prevent the inner shell 104 from rotating relative to the clamping ring 124. Because the clamping ring 124, in turn, is prevented from rotating relative to the crushing head 103 by way of the guide pins 129, it will not be possible for the inner shell 104 to rotate relative to the crushing head 103. Thus, a securing arrangement is obtained, in accordance with a concept similar to that described with reference to, in particular, FIGS. 4-5, in which the bolts 114 are not subjected to shear forces, since any such forces are absorbed by the lug-notch arrangement.

After the clamping ring 124 has been mounted by way of the bolts 114 and the lugs 136 have been secured by screwing in such a manner that the position of each recess 137 relative to each notch 138 is fixed, a protective cover 120 is mounted with the aid of two bolts 121, which are screwed to the clamping ring 124.

Figure 8:
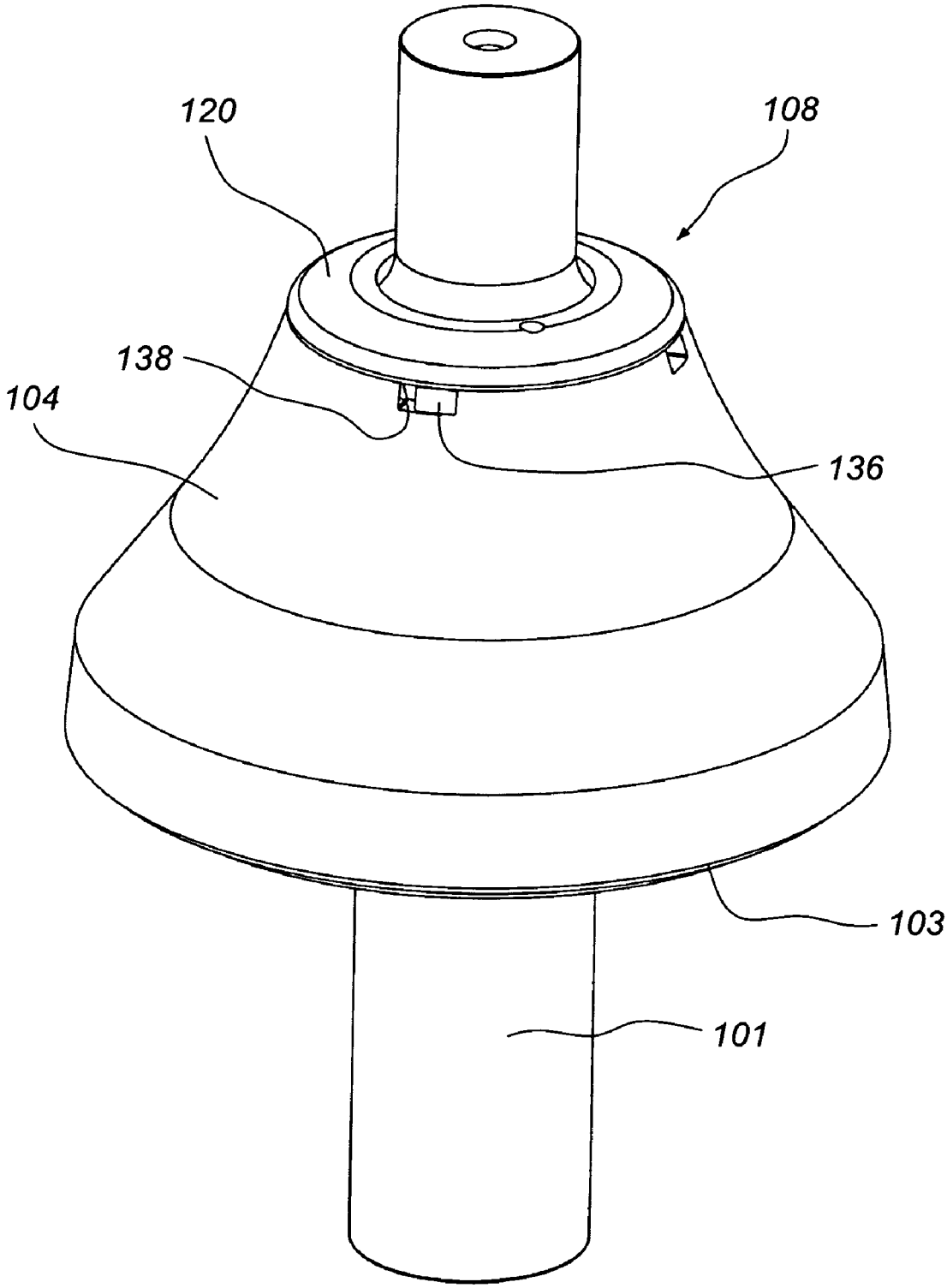
FIG. 8 is a side view of the inner shell when mounted on the crushing head.

FIG. 8 shows the inner shell 104 after it has been assembled on the crushing head 103 with the aid of the securing device 108. As shown in the figure, the only really visible parts of the device 108 are the protective cover 120, the notch 138 and the lug 136 that fixes the notch 138, and thereby the inner shell 104, relative to the clamping ring 124 and, thereby, relative to the crushing head 103.

Figure 9:
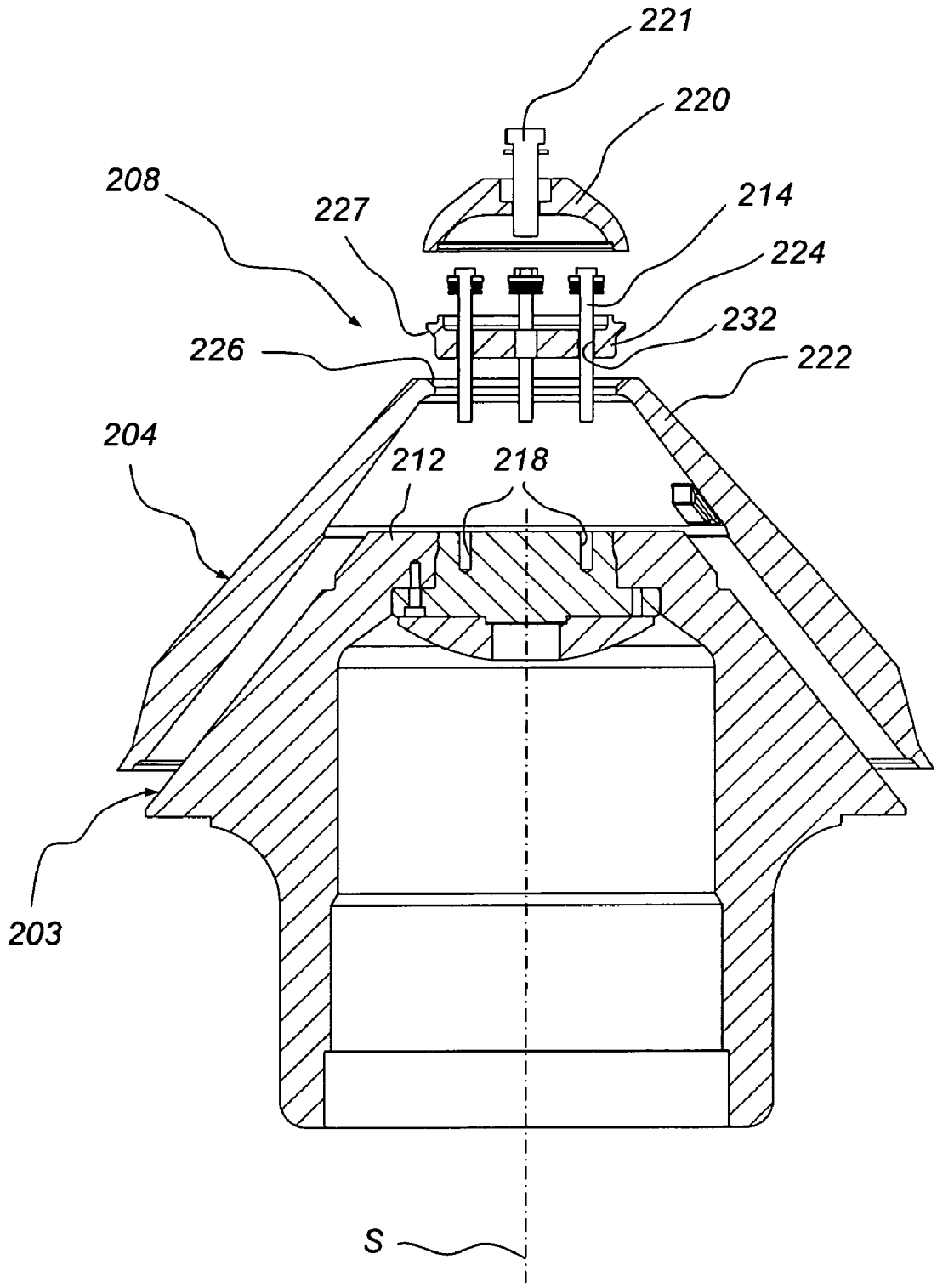
FIG. 9 is a schematic cross-sectional view of a device for securing an inner shell to a gyratory crusher according to a third embodiment.

FIG. 9 shows a crushing head 203 that is adapted for use in the type of crushers in which the crushing head rotates about a fixedly mounted crusher shaft, see for example FIG. 1 of US 2006/0113414A1. FIG. 9 of the present application further shows an inner shell 204, which is arranged to be fastened to the crushing head 203 with the aid of a securing device 208, which includes, inter alia, a clamping ring 224.

On the inside of its upper portion 222, the inner shell 204 is provided with a conical contact surface 226. The clamping ring 224 has a conical contact surface 227, which is configured to be moved into engagement with the contact surface 226 and press the inner shell 204 downwards, as shown in FIG. 9, towards the crushing head 203. In its upper portion 212, the crushing head 203 further has four threaded bolt holes 218, which have substantially the same design as the threaded bolt holes 18 shown in FIGS. 3*a* and 3*b*. The clamping ring 224 has four through bolt holes 232, the positions of which correspond to those of the threaded bolt holes 218. Four bolts 214 are arranged to be inserted through the bolt holes 232 extending through the clamping ring 224 and to be screwed into the bolt holes 218 in the crushing head 203. As shown in FIG. 9, the longitudinal extension of the bolts 214 is substantially parallel to the symmetry axis S of the crushing head 203. A protective cover 220 is arranged to be screwed to the clamping ring 224 with the aid of a center bolt 221.

Figure 10A:
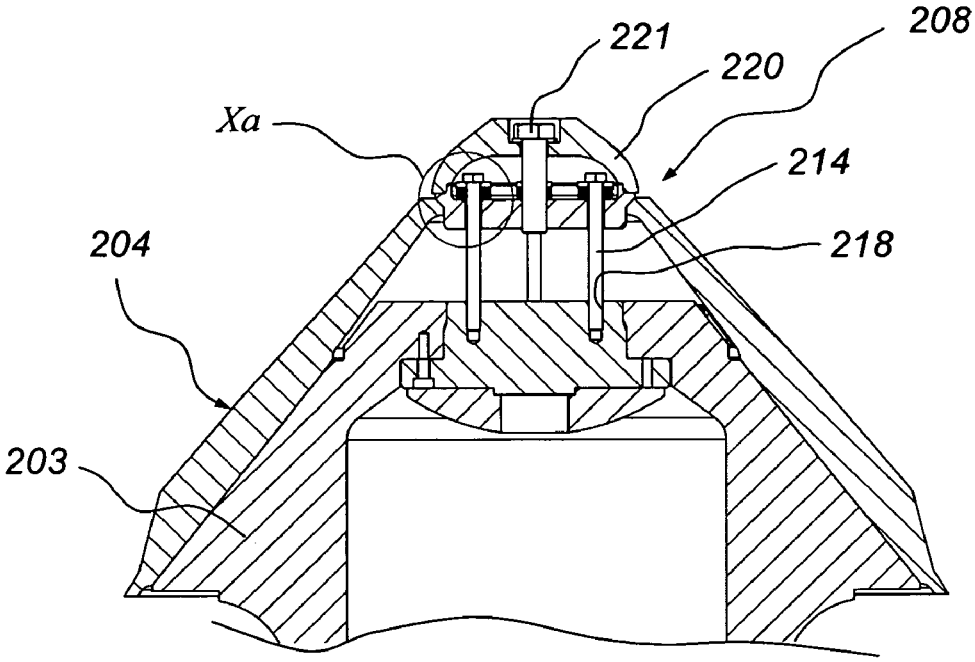
FIG. 10*a* is a cross-sectional view of the inner shell when mounted on the crushing head.

FIG. 10*a* shows how the inner shell 204 has been mounted on the crushing head 203 with the aid of the securing device 208. The protective cover 220 has been mounted on the securing device 208 with the aid of the center bolt 221 and protects the securing device 208 from incoming material to be crushed.

Figure 10B:
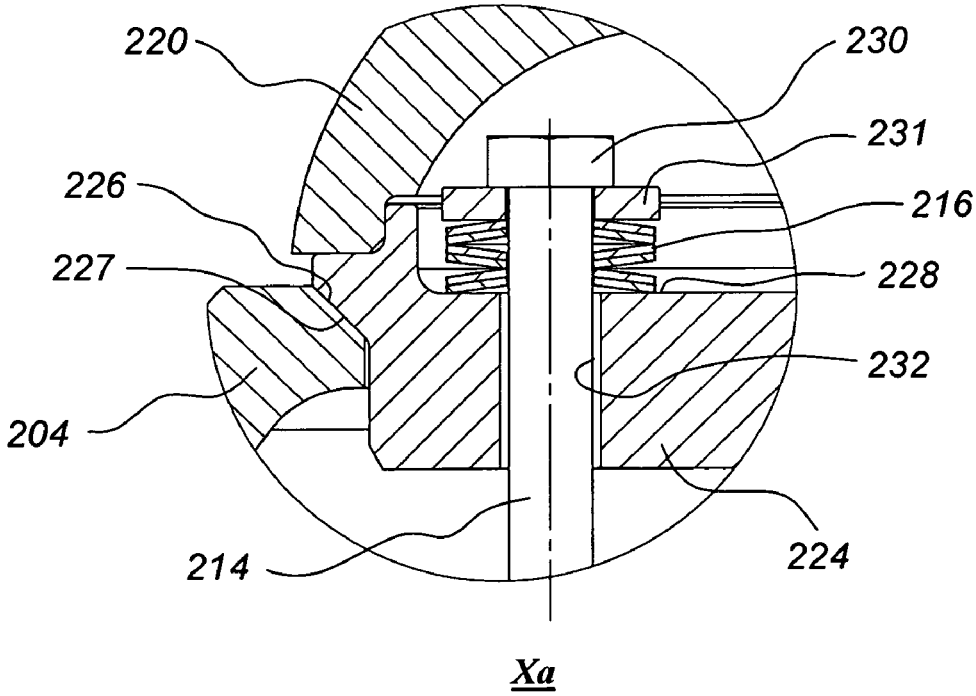
FIG. 10*b* is an enlarged cross-sectional view of the area Xa shown in FIG. 10*a*.

FIG. 10*b* is an enlargement of the area Xa shown in FIG. 10*a*. As illustrated, each bolt 214 is provided with a spring pile 216 of a type similar to the spring piles 16 described above. The bolt 214 has a bolt head 230, which, via a washer 231, forces the spring pile 216 against a spring seat 228 in the clamping ring 224. The bolt 214 is tightened in the manner described above, i.e., such that the spring pile 216 retains at least 5% of its spring play in the unloaded state. Thus, the securing device 208 works according to a concept similar to that of the securing device 8, the difference being that the bolts 214 push a clamping ring 224 downwards, which in turn pushes the inner shell 204 down towards the crushing head 203.

Figure 11:
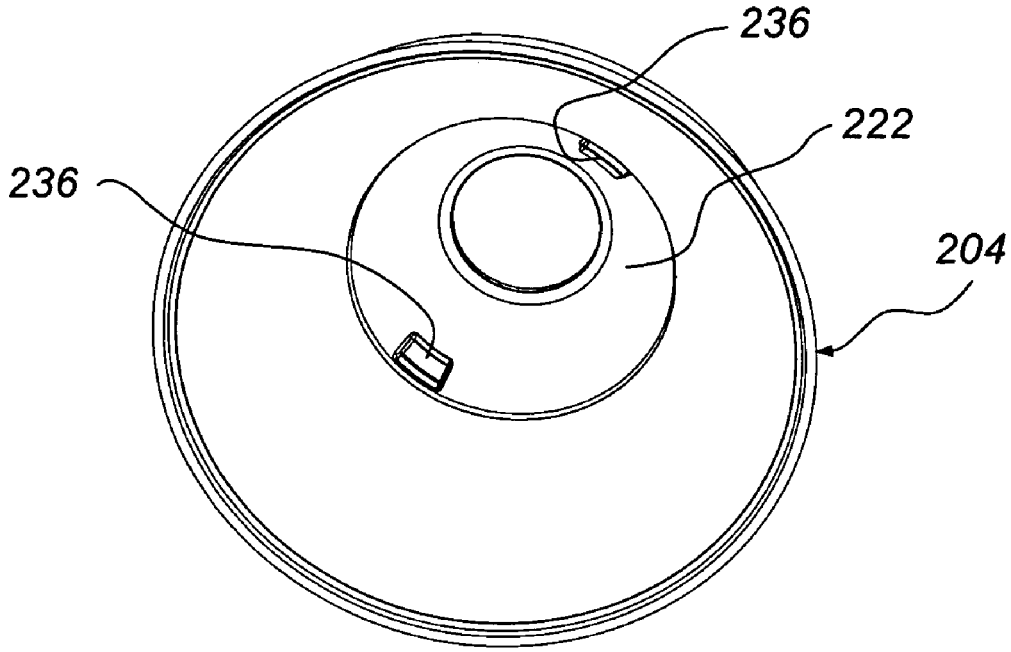
FIG. 11 is a three-dimensional view of an inner shell, as seen diagonally from below.

FIG. 11 shows how the inner shell 204, on the inside and in the upper portion 222 thereof, is provided with two lugs 236, which are uniformly distributed along the inner periphery of the inner shell 204. These two lugs 236 form first parts of a lug-notch arrangement, which is configured to prevent unlimited rotation of the inner shell 204 about the crushing head 203, as will be explained in greater detail below.

Figure 12:
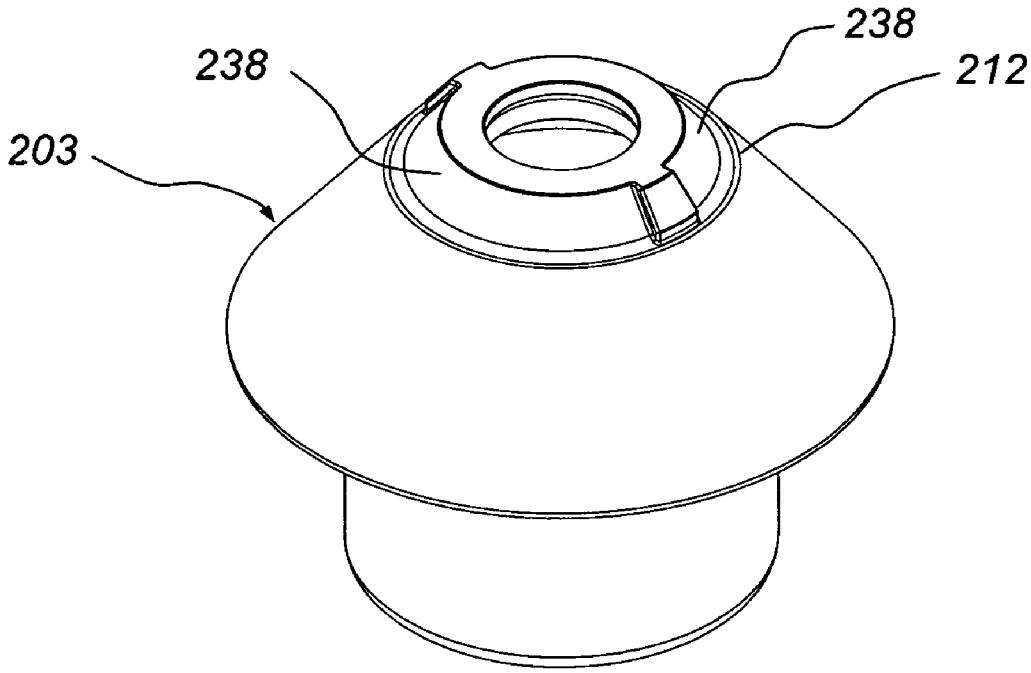
FIG. 12 is a three-dimensional view of a crushing head, as seen diagonally from above.

FIG. 12 shows the crushing head 203. In the upper portion 212 of the crushing head 203, two notches 238 are formed, which are uniformly distributed along the periphery of the crushing head 203. The notches 238 form second parts of the lug-notch arrangement mentioned above. When an inner shell 204 is to be mounted on the crushing head 203, the inner shell 204 is lowered onto the crushing head 203 in such a manner that the lugs 236 on the inside of the inner shell 204 are moved into engagement with the corresponding notches 238 in the outer periphery of the crushing head 203. When the lugs 236 are engaged with the notches 238, the ability of the inner shell 204 to rotate relative to the crushing head 203 is considerably reduced. This means that the bolts 214 shown in FIGS. 10*a* and 10*b* are not subjected to excessive shear forces during crushing of a material in the gyratory crusher. In the embodiment shown in FIG. 11 and FIG. 12, the maximum allowable rotation of the inner shell 204 will be less than half a turn. The notches 238 can be designed in alternative ways, for example a single notch may be provided, which is so wide that the inner shell can be turned almost a whole turn, but not more. It is also possible, and often preferable, to make the notches narrower, so that the inner shell can be turned less than a quarter of a turn, or most preferred not at all, about the crushing head.

It will be appreciated that a number of modifications of the embodiments described above are possible within the scope of the invention, as defined by the appended claims.

It will be appreciated, for example, that other types of lug-notch arrangements may be used and that the design, number and position of lugs and notches may vary.

It has been described above how to attach inner shells by way of bolts of the type that has a bolt head and a threaded rod attached thereto. It will be appreciated that also other types of bolts may be used, for example stud bolts. In the latter case, a nut is screwed onto the stud bolt when tightening. This means that the nut serves as a kind of bolt head.

According to the above description, the spring elements applied between the bolts 14 and the inner shell 4 may be spring piles 16. It will be appreciated that many different types of spring elements may be used when carrying out the present invention. Examples of suitable spring elements are cup springs, coil springs, rubber bushings and the like.

According to the above description, four or eight bolts 14, 114, 214 are used to fasten the inner shell 4, 104, 204. It will be appreciated that the number of bolts may be varied within a wide range. It is usually preferred to use 2 to 20 bolts for securing the inner shell, even more preferred to use 3 to 16 bolts, and the corresponding number of threaded bolt holes 18, 118, 218, which are suitably symmetrically distributed along the circumference of the crushing head.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A method of attaching, in a gyratory crusher, an inner shell to a crushing head having a lower portion and an upper portion that is narrower than the lower portion, the inner shell being configured to define, together with an outer shell of the crusher, a crushing gap for receiving a material to be crushed, comprising:

bringing the inner shell into contact with the crushing head by mounting the inner shell on the crushing head in a direction from the upper portion thereof towards the lower portion thereof;

using at least one lug to prevent unlimited rotation of the inner shell, when mounted on the crushing head, relative to said crushing head; and pressing the inner shell towards the lower portion of the crushing head by way of at least two threaded bolts, which are arranged in the upper portion of the crushing head such that their longitudinal direction is substantially parallel to the symmetry axis of the crushing head and then tightened.

2. The method according to claim 1, wherein at least one spring element is arranged between at least one of said at least two threaded bolts and the inner shell.

3. The method according to claim 2, wherein said at least two threaded bolts are tightened to such an extent that said at least one spring element, after said at least two bolts have been tightened, retains at least 5% of the spring play of the spring element in its unloaded state.

4. The method according to claim 1, wherein said at least two threaded bolts are inserted in bolt holes that are provided in a flange arranged in the upper portion of the inner shell, and tightened so as to press said flange, and thereby the inner shell, towards the lower portion of the crushing head.

5. The method according to claim 1, wherein said at least two bolts are inserted in bolt holes that are provided in a clamping ring, and tightened so as to press said clamping ring towards the upper portion of the inner shell.

6. An inner shell, which is configured to be attached, in a gyratory crusher, to a crushing head having a lower portion and an upper portion that is narrower than a lower portion to define, together with an outer shell, a crushing gap for receiving a material to be crushed, comprising:

a first part of a lug-notch arrangement, which first part is arranged to prevent, in co-operation with a second part of said arrangement, unlimited rotation of the inner shell relative to the crushing head;

a contact surface in its upper portion and being arranged to be pressed towards the lower portion of the crushing head by a pressing force acting on the contact surface and obtained by tightening at least two threaded bolts, which are arranged in the upper portion of the crushing head such that their longitudinal direction is substantially parallel to the symmetry axis of the crushing head, wherein the first part of a lug-notch arrangement includes lugs or notches in a lower portion of the inner shell, lugs or notches on an inner surface of an upper portion of the inner shell below an upper opening of the inner shell, or notches in the upper portion of the inner shell adjacent the contact surface.

7. The inner shell according to claim 6, which at its upper end has a substantially horizontal flange, which has at least two bolt holes in which said at least two threaded bolts are insertable.

8. The inner shell according to claim 6, wherein the contact surface is arranged to absorb pressing forces from a clamping ring, which is adapted to be pressed against the contact surface by said at least two threaded bolts.

9. The inner shell according to claim 6, wherein said first part comprises, formed on the inner shell and projecting in the direction of the crushing head, at least one lug, which is arranged to engage a corresponding notch formed in the crushing head and being part of said second part.

10. The inner shell according to claim 9, wherein said at least one lug is arranged in the upper portion of the inner shell.

11. The inner shell according to claim 6, wherein said first part comprises, formed in the inner shell, at least one notch, which is arranged to engage a corresponding lug formed adjacent the crushing head and being part of said second part.

12. The inner shell according to claim 11, wherein said at least one notch is provided in the upper portion of the inner shell.

13. The inner shell according to claim 6, wherein the inner shell is provided with a spring seat, which is configured for the arrangement of a spring element between the inner shell and one of said at least two threaded bolts.

14. A gyratory crusher, comprising:

an inner shell, which is attached to a crushing head having a lower portion and an upper portion that is narrower than the lower portion, and an outer shell, which is attached to a frame forming part of the crusher and which, together with the inner shell, defines a crushing gap for receiving a material to be crushed;

a lug-notch arrangement configured to prevent unlimited rotation of the inner shell relative to the crushing head, wherein the inner shell has a first part in the lug-notch arrangement, and a corresponding second part of the lug-notch arrangement is arranged adjacent the crushing head, the inner shell being pressed towards the lower portion of the crushing head by way of at least two threaded bolts, which are arranged in the upper portion of the crushing head such that their longitudinal direction is substantially parallel to the symmetry axis of the crushing head.

15. The gyratory crusher according to claim 14, wherein at least one spring element is arranged between at least one of said at least two threaded bolts and the inner shell.

16. The gyratory crusher according to claim 15, wherein said at least two threaded bolts have been tightened to such an extent that said at least one spring element retains at least 5% of the spring play of the spring element in its unloaded state.

17. The gyratory crusher according to claim 15, wherein said at least one spring element comprises a cup spring, a coil spring or a rubber bushing.

18. The gyratory crusher according to claim 15, which is without a main shaft nut that is rotatable about the symmetry axis of a vertical shaft carrying the crushing head.

19. The gyratory crusher according to claim 14, wherein the inner shell is provided with a flange in its upper portion, said at least two bolts being inserted in bolt holes in said flange and forcing said flange, and thereby the inner shell, towards the lower portion of the crushing head.

20. The gyratory crusher according to claim 14, wherein said at least two bolts are inserted in bolt holes provided in a clamping ring, which engages the upper portion of the inner shell, the bolts forcing the clamping ring, and thereby the inner shell, towards the lower portion of the crushing head.

* * * * *